US005213151A

United States Patent [19]

Hackman

[11] Patent Number: 5,213,151

[45] Date of Patent: May 25, 1993

[54] MELT OVERFLOW CONTROL FOR CONSTANT LINEAR DENSITY FIBER MAT AND STRIP

[75] Inventor: Lloyd E. Hackman, Worthington, Ohio

[73] Assignee: Ribbon Technology Corporation, Gahanna, Ohio

[21] Appl. No.: 932,576

[22] Filed: Aug. 20, 1992

[51] Int. Cl.[5] ..... B22D 11/20; B22D 11/18

[52] U.S. Cl. ..... 164/453; 164/454; 164/449; 164/413

[58] Field of Search ..... 164/450, 451, 452, 453, 164/454, 449, 463, 423, 413, 155, 4.1

[56] References Cited

U.S. PATENT DOCUMENTS

| | | | |
|---|---|---|---|
| Re. 33,327 | 9/1990 | Hackman et al. . | |
| 3,528,479 | 9/1970 | Cole et al. | 164/449 |
| 3,838,185 | 9/1974 | Maringer et al. . | |
| 3,871,439 | 3/1975 | Maringer et al. . | |
| 4,930,565 | 6/1990 | Hackman et al. . | |
| 4,977,951 | 12/1990 | Hackman . | |
| 5,061,841 | 10/1991 | Richardson . | |

FOREIGN PATENT DOCUMENTS

| | | | |
|---|---|---|---|
| 3003917 | 8/1980 | Fed. Rep. of Germany | 164/453 |
| 0115656 | 5/1988 | Japan | 164/452 |

*Primary Examiner*—Richard K. Seidel
*Assistant Examiner*—Erik R. Puknys
*Attorney, Agent, or Firm*—Frank H. Foster

[57] ABSTRACT

A melt overflow apparatus for controlling various elements in response to incremental changes in parameters which affect the linear density of a continuous metal fiber mat or metal strip being produced is described. The net width of fibers being cast against a rotating, cylindrical casting wheel is measured by an infrared detector. A similar infrared detector is used to measure the net width of a metal strip being formed against a casting wheel. The weight of a portion of the strip or fiber mat is also measured. The weight and net width values are relayed to a control system which then controls various elements used in producing the metal product. These devices include electric motors driving both the casting wheel and a conveyer means for transporting the fiber mat or strip. A ceramic plunging body driven into a pool of molten metal to overflow onto the casting wheel can also be controlled.

21 Claims, 4 Drawing Sheets

MELT OVERFLOW CONTROL FOR CONSTANT LINEAR DENSITY FIBER MAT AND STRIP

TECHNICAL FIELD

This invention is directed to the field of rapid solidification casting using a melt overflow method. The invention is more specifically directed to control systems for monitoring product parameters, controlling manufacturing operations, and changing the manufacturing operations, in response to changes beyond specified limits of the product parameters, in order to achieve a product of desired characteristics.

BACKGROUND ART

Melt overflow casting is a type of rapid solidification in which a metal product, such as a thin, short fiber or a wide, continuous strip, is formed by casting molten metal against the outer, peripheral surface of a rotating, cylindrical casting wheel. The molten metal solidifies on the casting wheel, is carried out of the molten pool and projected off of the casting wheel onto a surface such as a conveyor. Fibers cast onto the conveyor become entangled, forming a continuous mat. Melt extraction rapid solidification is taught in U.S. Pat. Nos. 3,871,439 and 3,838,185, both to Maringer, et al. and melt overflow rapid solidification is taught in U.S. Pat. No. 4,930,565 and U.S. Pat. No. Re. 33,327 to Hackman, et al.

The dimensions of the fiber mat or strip formed by a melt overflow process are controlled by a number of variables. Examples of these variables are the height of the liquid metal interfacing against the casting wheel, the velocity of the casting wheel and, especially for fibers, a large number of which are formed across the width of the casting wheel, the net width of fibers being produced. If a metal piece solidifies in the molten pool near the casting wheel and blocks fibers from being produced in that region of the casting wheel, then the net width is reduced and fewer fibers will be projected from the casting wheel. The total number of fibers projected from the casting wheel per unit of time will decrease. The fibers are commonly projected onto a moving conveyor to form a mat, and fewer fibers being projected onto the conveyor per unit of time will result in a mat of lower density. Usually, the interfering piece of metal which has solidified near the casting wheel and blocks the fiber from being produced is eliminated by scraping, after which the mat will return to its normal density. However, the overall result of this variation in the number of fibers being projected per unit of time is a fibrous mat having a discontinuous linear density.

Most melt overflow casting machines use some method of maintaining the height of the top surface of the molten metal pool. For example, a ceramic body may be submersed down into the pool at a specified rate as in U.S. Pat. No. 4,977,951 to Hackman. The rate at which the ceramic body displaces metal is equal to the rate at which metal is removed from the pool in order to maintain a constant pool height with respect to the casting wheel. However, if a portion of the width of the casting wheel that would normally produce fibers is blocked, then the dimensional control of the product is reduced, the surface level of the pool will rise and the remaining regions that can produce fibers will produce fibers of greater thickness or strip than if the entire width of the casting wheel were able to produce fibers. This is due to the fact that in general, the rate of descent of the ceramic plunger is set at a specified value of overflow or displacement rate in order to achieve a specified mass of output of metal per unit of time. If the number of fibers being projected off of the casting wheel decreases, but the output mass per unit of time from the molten pool remains constant, then the mass of each fiber that is produced will be greater. This results in a mat having inconsistently sized fibers which detracts from the desired homogeneity of the mat.

In the formation of a continuous, wide strip, the strip is projected onto a conveyor and has a constant width. The linear volume of the strip is primarily a function of the thickness of the strip and is desirably kept substantially constant as in the case of the fiber mat. The width of the strip may fluctuate slightly during casting, but since width only varies a small amount in relation to the total width, the most important parameter with respect to linear volume in strip casting is the thickness. If the thickness varies along the length of the strip, then the linear volume fluctuates significantly, due to the relation of a fluctuation in thickness to the total thickness. Since the thickness of the strip is much smaller than the width of the strip, a small fluctuation in the thickness represents a greater proportion of the desired thickness than the same amount of fluctuation in the width. Therefore, thickness fluctuations cause significant nonuniformities in the strip produced.

The velocity of the casting wheel and the height of the molten metal pool against the casting wheel have a large effect on the thickness of the strip just as they do in fiber casting. Generally, a more rapidly rotating casting wheel provides thinner strip and fiber.

There are a great many variables involved in forming substantially constant linear volume strip and fiber mat. Therefore there is a need for a means and method for controlling the linear volume of the two types of cast metal products in response to variations in the manufacturing parameters in order to produce uniform products.

BRIEF DISCLOSURE OF INVENTION

In melt overflow casting, a sub-category of rapid solidification technology, a rotatably driven casting which has molten metal cast against its side. The molten metal solidifies as predetermined length fibers or as a long, continuous strip. The casting wheel carries the molten metal out of a molten pool, freezing the wheel surface which projects the solidified metal onto a conveying means, forming a continuous mat in the case of the fibers. The purpose of the conveying means is to transport the solidified metal, and the apparatus also includes a height control means for controlling the height of the top surface of the pool of molten metal. The improvement comprises a sensing means for measuring the net width across the casting wheel of the solidified metal product, and a control means for controlling various drive means in the apparatus in response to incremental changes in the net width of the solidified metal on the casting wheel. The improvement maintains a substantially constant linear volume in the final product.

The invention may include a weighing means for measuring the weight of a portion of a continuous metal strip, and may also include a feedback control means controlling the angular velocity of the casting wheel and the velocity of the conveying means in response to small, incremental changes in the linear volume of the solidified metal.

Figure 1:
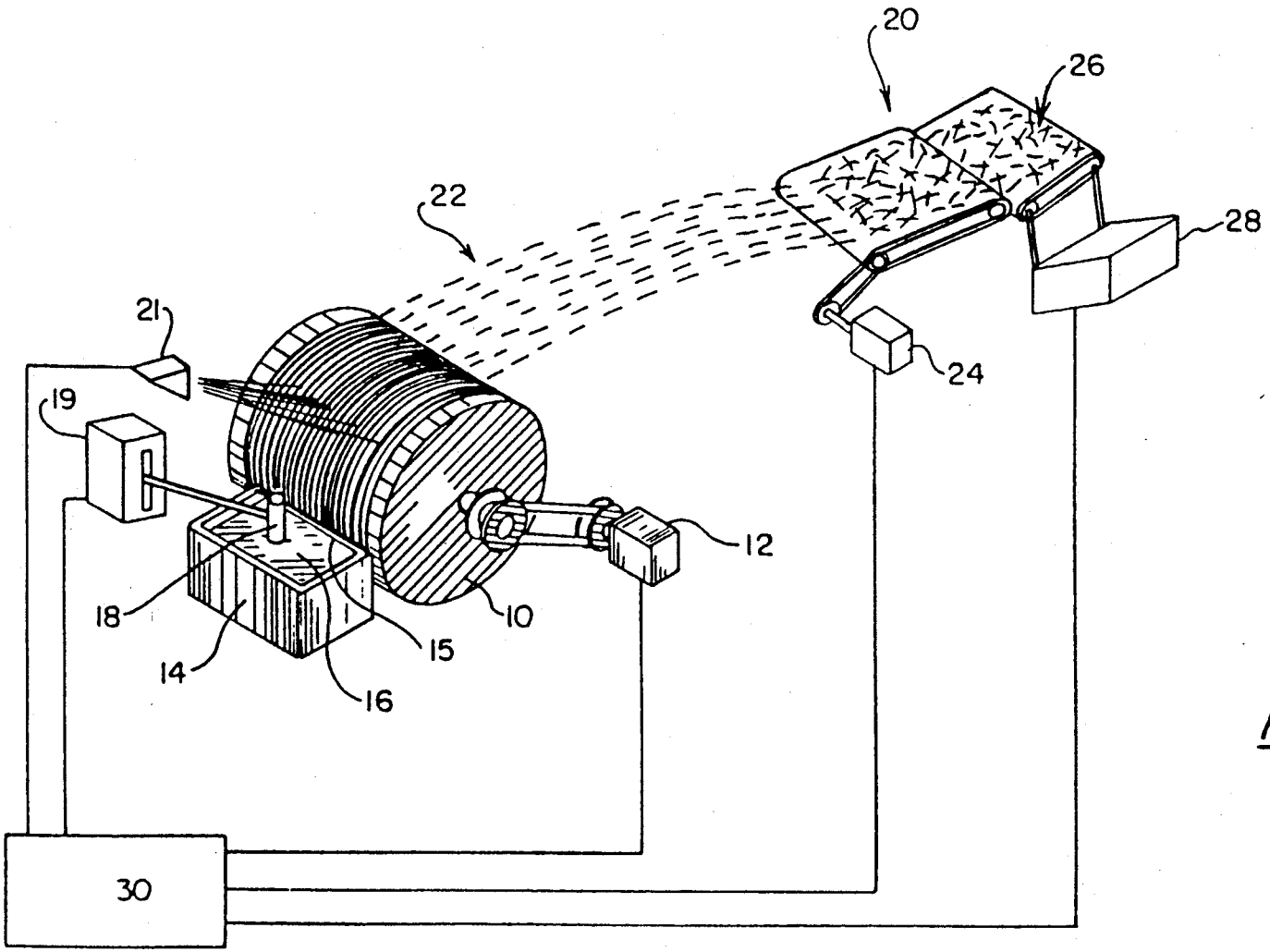
FIG. 1 is a view in perspective illustrating one embodiment of the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other circuit elements where such connection is recognized as being equivalent by those skilled in the art.

DETAILED DESCRIPTION

In one aspect of the present invention, parameters which affect the linear volume of metal fiber mat or metal strip are measured during production. In response and during production, specific parameters such as motor speeds are changed in response to measured changes in the linear volume, with respect to reference values, in order to correct the production to attain the desired uniform linear volume. Linear volume is a measure of the length and width along the longitudinal direction of the continuous metal strip or continuous fiber mat, assuming the volume to be constant across the longitudinal axis, i.e. in section. Linear volume denotes the mass per unit length of a material, whereas the more common volumetric density is a measure of the mass per unit volume of material.

FIG. 1 illustrates an embodiment of the present invention as used with a conventional melt overflow casting apparatus. The melt overflow apparatus includes a cylindrical casting wheel 10 that is rotatably driven by, for example, a variable speed electric motor 12. A hearth or crucible 14 is also included in the melt overflow apparatus and has four walls and a bottom. One wall 15 of the hearth 14 has a portion with a top edge that is lower than the other walls. The hearth 14 is filled with molten metal 16 and the wall 15 is placed very near the outer circumferential surface of the casting wheel 10. A height control means, preferably a ceramic plunging means 18 for displacing molten metal 16, is submerged into the molten metal 16 by a suitable driving means 19 causing the molten metal 16 to initially rise and overflow over the top edge of the wall 15, and then maintain a constant level during steady state operation.

The molten metal 16 overflows onto the outer surface of the casting wheel 10, solidifies, is carried up and over the casting wheel 10 and is projected tangentially from the casting wheel 10. The height control means, in the preferred embodiment comprising the plunging means 18 and the driving means 19, may alternatively be a tilting hearth which tilts toward the casting wheel in order to cause the molten metal to overflow onto the casting wheel. Control of the tilting rate of the hearth controls the height of the molten metal 16. The tilting hearth requires a drive means which would be a substitute for the drive means 19.

The above described melt overflow casting apparatus is known in the art, and the embodiment of the present invention illustrated in FIG. 1 works in conjunction with the known melt overflow apparatus. The invention includes a sensing means, for example, an infrared detector 21 which detects infrared waves being emitted by metal fibers 22 along a line on the casting wheel 10 parallel to the axis of the casting wheel 10. This allows the net width of the stream of fibers 22 to be measured by the infrared detector 21. The fibers 22 are projected tangentially from the casting wheel 10 onto a conveyor 20 driven, for example, by a variable speed electric motor 24. The fibers 22 are projected onto the conveyor 20 where they become entangled, forming a mat 26.

The infrared detector 21, the driving means 19 and the electric motors 12 and 24 are all connected to a control means 30. The control means 30 receives the net width information signal from the infrared detector 21 and then controls the drive rates of the driving means 19 and the electric motors 12 and 24 driving the casting wheel 10 and the conveyor 20, respectively. This control can be accomplished by, for example, a feedback control system or a computer which accepts signals from the sensors and calculates new speeds. A combination of a computer and a feedback control system would also accomplish the task of controlling the output by sensing certain parameters and changing production to keep the parameters within a specified limit. This can be done by application of well known feedback control principles and control algorithms.

The infrared detector 21 functions in a conventional manner having a lens which focuses the infrared waves onto a detector. The infrared detector 21 may scan the width of the casting wheel 10 by moving a reflective mirror to reflect the infrared waves onto the infrared detector 21. Alternatively, the infrared detector 21 may itself be moved to scan across the width of the casting wheel 10 to sense the infrared waves emitted by the fibers 22. As another alternative, the infrared detector 21 may be made up of a series of detectors for sensing infrared waves across the entire width of the casting wheel 10 without movement of the detectors or a mirror. The important feature of the infrared detector 21 is that it detects infrared waves being emitted from the stream of fibers 22, and when a change in net width occurs due to a blockage in the melt, the infrared detector 21 senses the reduced net width.

The metal fibers 22 emit a significantly greater amount of infrared waves than the casting wheel 10 on which they are cast, since they are as much as 1000 F hotter than the casting wheel 10. This large temperature differential causes a large differential in the amount of infrared waves emitted and makes detection of change in the net width of the stream of metal fibers 22 on the casting wheel 10 possible.

Infrared sensing technology is known and is not claimed as the present invention. The present invention merely uses the prior infrared sensing technology in a unique and different way. Additionally, a video process that could be used for sensing net width of the cast fiber is taught by Richardson in U.S. Pat. No. 5,061,841. This process may be used as an alternative to the above described infrared sensing, and would serve as a substitute for the infrared sensing means. Other video processing and detection techniques are known in the robotics art.

The thickness of the metal fibers 22 being cast is principally a function of the height of the molten metal 16 in contact with the casting wheel 10 and the surface speed of the rotation wheel. The volume of the fibers 22 is known if the thickness, width and length of the fibers 22 are known. Therefore, if the height of the molten metal 16 in contact with the casting wheel 10 is maintained at a constant value, then the thickness of the metal fibers 22 will remain constant as well at a constant wheel surface speed. The plunging means 18 and driving means 19 maintain this constant height as taught by Hackman in U.S. Pat. No. 4,977,951. Therefore the relative volume of metal being cast into fibers 22 can be determined from the net width of the fibers 22 as they are cast over the casting wheel 10, since the thickness of the fibers 22 remains constant.

When the fibers 22 are projected onto the conveyor 20, they form a mat 26 that has a density which equals a desired value along the length of the mat 26 if the following ideal conditions are met. The fibers 22 should ideally be projected onto the conveyor 20 at a constant rate (number of fibers per unit of time), and the conveyor 20 should ideally move at a constant velocity (change in distance per unit of time). This ideal situation gives a constant number of identical fibers per length of mat 26, i.e. a constant linear density. Since variations from the ideal situation normally occur, the velocity of the conveyor 20 may need to be varied by the control means 30 varying the speed of the motor 24. This is done to compensate for a variation in the number of fibers 22 projected onto the conveyor 20 per unit of time.

This variation occurs when small pieces of solidified metal or slag form at the interface between the top edge of the wall 15 over which the molten metal 16 overflows and the outer surface of the casting wheel 10. The solidified pieces block the molten metal 16 from overflowing onto certain areas of the casting wheel 10. The possibility of forming interfering metal pieces at this interface is very likely when producing fibers 22 due to the low height of molten metal 16 at the interface when producing fibers 22 as opposed to most other strip or sheet products formed by the melt overflow process which use greater heights. The blockage caused by solidified metal pieces reduces the net width of fibers 22 that can be cast by reducing the total area on the casting wheel 10 onto which metal may overflow. This reduction in net width results in a reduction in the number of fibers 22 which are projected onto the conveyor 20 per unit of time. This results in the need for a slower conveyor 20 speed, to maintain a constant number of fibers 22 per length of mat 26.

An object of the present invention is to have the infrared detector 21 sense a change in the net width of fibers 22 being cast on the casting wheel 10. This information is then sent to the control means 30 which receives the net width value and sends a signal to achieve a new conveyor 20 speed in order to maintain a constant linear density mat 26. By varying the velocity of the conveyor 20 in response to variations in the number of fibers 22 which land on the conveyor per unit of time, the number of fibers 22 forming a length of the mat 26 is controlled, thereby controlling the linear density of the mat 26.

The control means 30 not only controls the speed of the conveyor 20, as discussed above, but may also control the driving means 19 to slow the rate of descent of the plunging means 18. The preferred apparatus has a separate sensor in the molten metal 16 to measure the height of metal 16. This sensor is connected to the drive means 19 which is sped up or slowed down to maintain a constant height. The plunging means 18 is slowed in response to the decrease in the amount of molten metal 16 being removed from the hearth 14. The decrease in the amount of molten metal 16 being removed from the hearth 14 per unit of time is a necessary result of the decrease in the number of fibers 22 being produced per unit of time due to the blockage.

As an alternative to the preferred embodiment, a weighing means 28 may be connected to the conveying means 20 to sense the weight of a length of mat 26 as the mat 26 passes over the portion of the conveyor 20 to which the weighing means 28 is connected. The weight of fibers on the known, constant length of the weighing means is relayed to the control means 30 which, if it is necessary, will vary one or more of the driving means which it controls to maintain a constant weight of fibers on the weighing means and therefore a constant linear density mat 26.

Figure 2:
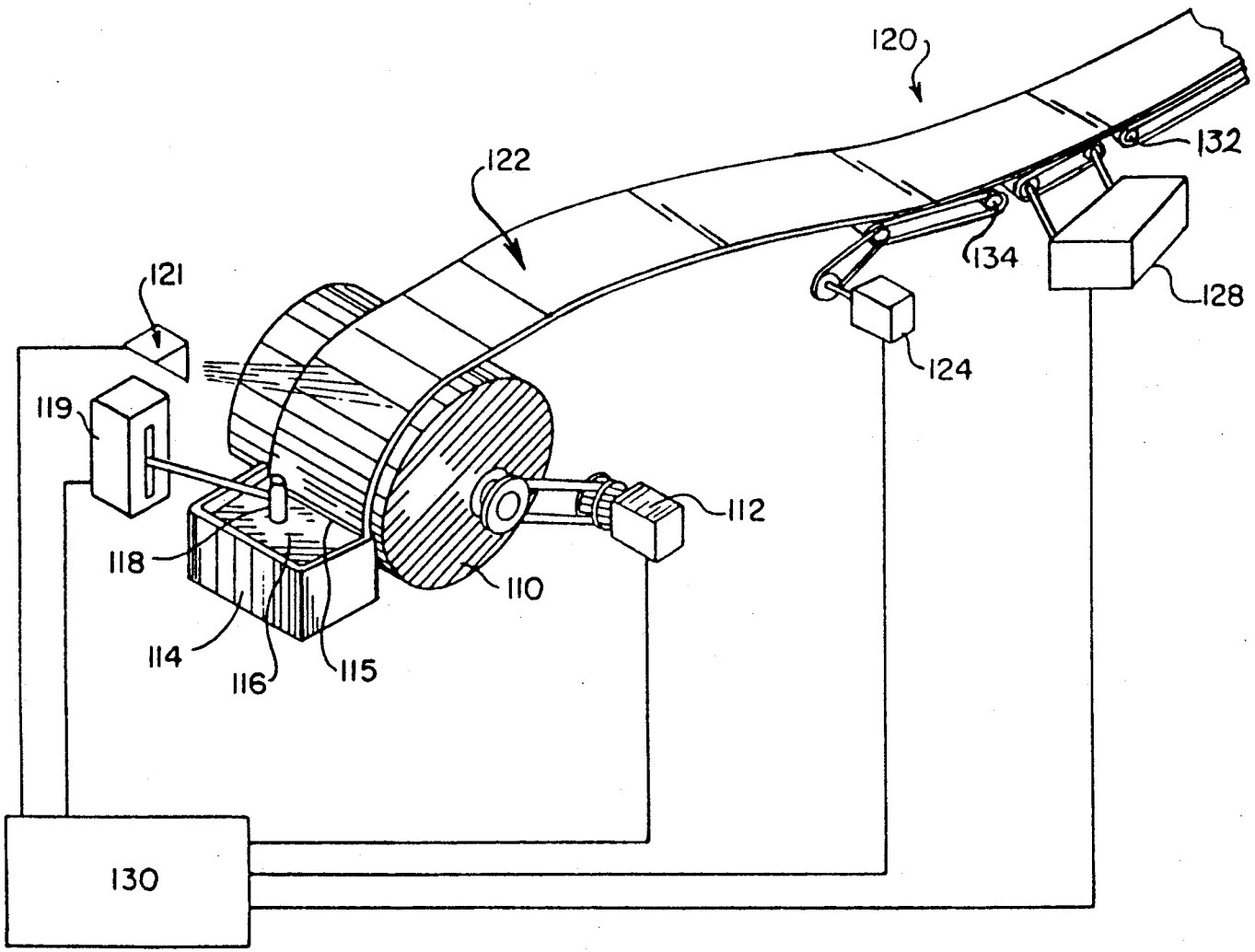
FIG. 2 is a view in perspective illustrating another embodiment of the present invention.

FIG. 2 shows an apparatus similar to that in FIG. 1 except that it is for the production of metal strip 122 instead of the metal fibers 22 of FIG. 1. The metal strip 122, which is preferably unbroken throughout production, is formed by a melt overflow apparatus which is known in the art and, as with the embodiment of FIG. 1, the melt overflow apparatus is not claimed as the present invention. The melt overflow apparatus includes a rotating, cylindrical casting wheel 110 and a hearth 114 having one wall 115 which is lower than the other three. The hearth 114 has molten metal 116 in it which overflows over the wall 115 onto the rotating casting wheel 110 forming the solidified metal strip 122 as is known in the art.

The embodiment of FIG. 2 has an infrared detector 121 as the preferred sensing means which functions in a manner similar to that of the embodiment of FIG. 1. A ceramic plunging means 118 is driven downwardly into the molten metal 116 by a driving means 119 as in FIG. 1. As with the embodiment of FIG. 1, a tilting hearth and drive means may be substituted for the plunging means 118 and drive means 119. Two electric motors 112 and 124 drive the casting wheel 110 and conveyor means 120, respectively. A weighing means 128 is connected to a region of the conveyor means 120 and measures the weight of a length of the metal strip 122. A feedback control means 130 is connected to the driving means 119, electric motors 112 and 124, the infrared detector 121 and the weighing means 128. The feedback control means 130 functions similarly to the control means 30 described for the embodiment of FIG. 1.

Figure 3:
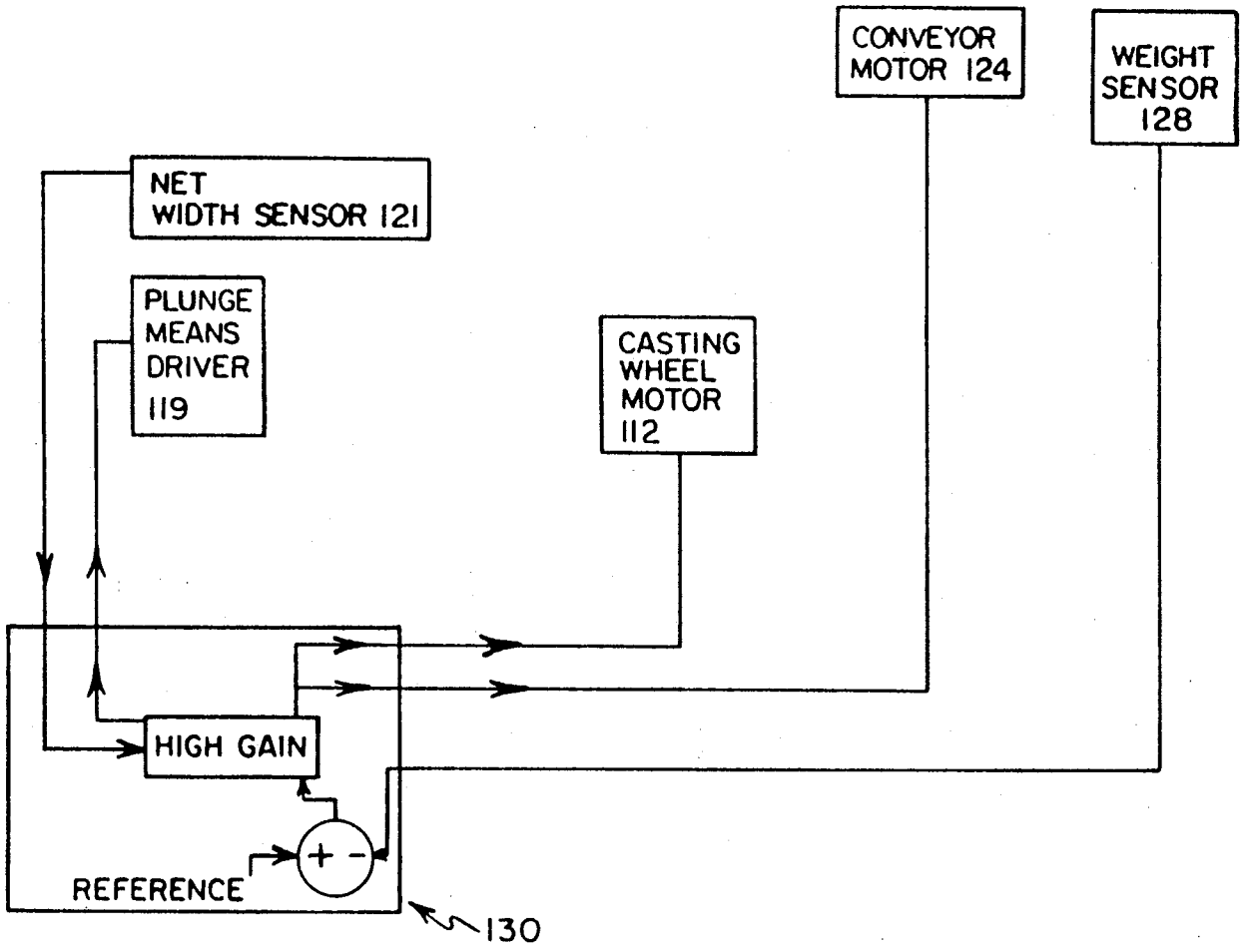
FIG. 3 is a block diagram illustrating the control means' connection to other elements.

The feedback control means 130 and the elements of the embodiment of FIG. 2 to which it is connected are illustrated in FIG. 3. The elements illustrated in FIG. 2 are shown having the same numbers in FIG. 3, the embodiment of FIG. 3 being a block diagram of the feedback control means 130 that is the preferred control means of the embodiment of FIG. 2.

The feedback control means 130 functions as a negative feedback control. As the input value is compared to a reference value at a summing junction, the difference between the two is sent to the high-gain amplifier which sends a signal to one or more elements of the apparatus in order to change the difference between the reference value and the input value in the opposite direction toward the reference value. This causes the properties of the product to be maintained very near the reference value. The reference value in the embodiment of FIG. 3 is mass per unit length of strip 122 derived from the weighing means 128.

The embodiment of FIG. 3 functions as follows. The sensing means 121 and weighing means 128 detect width and weight information on the strip 122 being cast and send that information to the feedback control means 130. Inside the feedback control means 130 the input information from the weighing means 128 is compared to a reference value at a summing junction which determines the difference between the actual value and the reference value. The information from the summing junction and from the infrared sensor 121 is then sent to a high-gain amplifier which sends a signal to the casting wheel motor 112, conveyor motor 124, and plunging means driver 119 to control the speeds of those devices.

For the embodiment of FIG. 2, a computer is preferably included as part of the feedback control means 130. The computer receives the signals from the weight and net width sensing devices, and then, for example, converts them to numbers. The numbers are then used to calculate a new value, which in the embodiment of FIG. 2, is thickness. This value is then converted back to a signal which is sent into the negative feedback control and comes out of the feedback control means 130 as an amplified correction signal sent to, for example, the casting wheel motor 112.

For the present invention, the following algorithms serve as transfer functions for the control means 30 of FIG. 1 and the feedback control means 130 of FIG. 2.

For casting fibers:

$$\frac{m}{l} = \frac{kw}{s}\,[f(h,\ v,\ T_c,\ \Delta T)]$$

where m=mass of fiber mat or strip
l=length of fiber mat or strip
v=casting wheel surface velocity
w=net width of cast metal on casting wheel
h=height of molten metal against casting wheel
s=conveyor velocity
k=proportionality constant
$T_c$=Thermal Conductivity
ΔT=Melt Temperature - Coolant Temperature For casting metal strip:

$$t = k[f(h, v, T_c, \Delta T)]$$

where t=thickness of cast strip

These equations show the relation between measured parameters and the parameters that can be varied.

Of great concern in the formation of metal strip 122 is the maintenance of a constant thickness along the length of the strip 122. This is analogous to constant linear weight because, when the thickness varies along the length of the strip 122, the amount of material per increment of length varies as well. Therefore, if the thickness varies, then the linear weight of the metal strip 122 varies. It is desirable to measure the thickness of the strip 122 and correct the casting process upon detection of a variation in the thickness.

The embodiment illustrated in FIG. 2 has a weighing means 128 connected to a portion of the conveyor means 120, preferably interposed between two adjoining conveyors 132 and 134. The metal strip 122 is projected from the casting wheel 110 in the conventional way and lands on a first conveyor 134. After stabilizing on the first conveyor 134 and travelling a significant distance, the metal strip 122 is transported onto a second conveyor to which the weighing means 128 is connected. The metal strip 122 is then conveyed onto a third conveyor 132 which is preferably on the same level as the first conveyor 134. The weight per length of metal strip 122 is relayed from the weighing means to the feedback control means 130 which, if necessary, varies the speed of the electric motor 112 or the driving means 119 in order to attain a strip 122 thickness which is desirable. If the thickness increases, the casting wheel is rotated at a sufficiently higher speed to maintain an essentially constant thickness in accordance with feedback control principles. The conveyor is also driven at a higher speed to match the output of the casting wheel.

The weight of the length of strip 122 is measured by measuring the downward force of the length of strip 122 on the weighing means 128, calibrated to give a value considering the end effects of the leading and following portions of the strip 122 due to transfer from one conveyor to another. The calibration of the weighing means considers the spring effect of the bent regions at both ends of the length of strip 122 being weighed. The spring effect is normally considered to be negligible, although when it is substantial, the spring effect may be compensated for in the calibration.

The thickness of the strip 122 is calculated by a computer, for example, from the known width measurement, made by the infrared detector 121 and the weight per length of the metal strip 122. The weight per length of the metal strip 122 is measured by the weighing means 128 and, since the mass per unit volume of the metal forming the strip 122 is generally constant, the thickness of the metal strip 122 can be calculated by combining the mass, mass per volume, length and width values.

Figure 4:
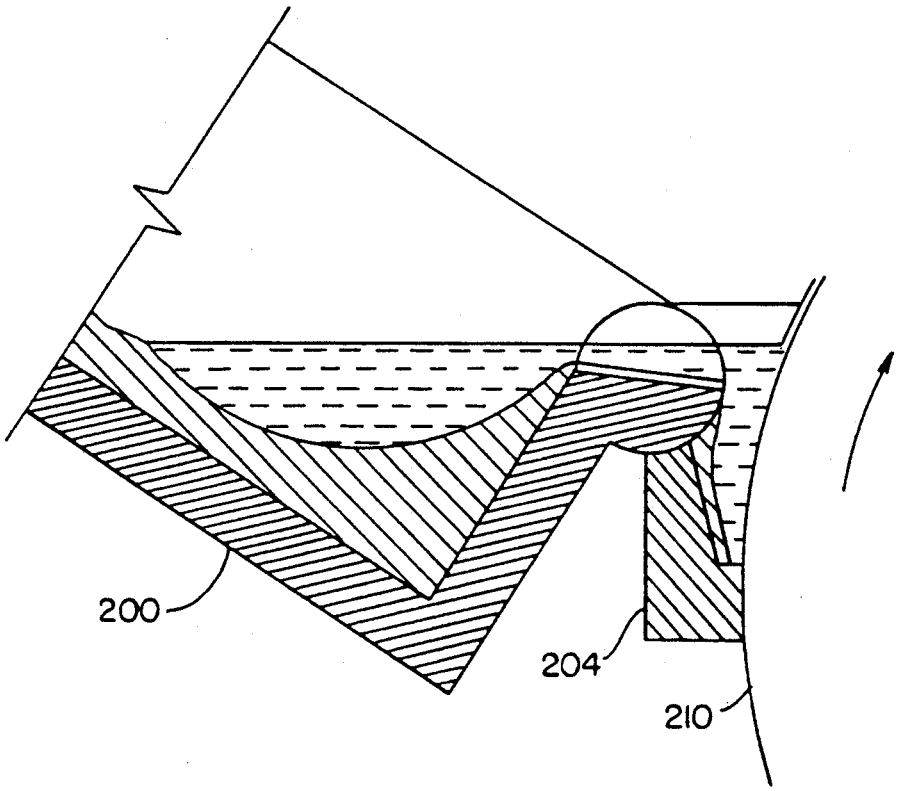
FIG. 4 is a side view in section of an alternative height control means.

FIG. 4 shows an alternative to a plunging body for height control. A hearth 200 is pivotally mounted to a basin 204. The basin 204 is in close proximity to the outer surface of a casting wheel 210. The hearth 200 can tilt with respect to the basin 204 and is an alternative height control.

While certain preferred embodiments of the present invention have been disclosed in detail, it is to be understood that various modifications may be adopted without departing from the spirit of the invention or scope of the following claims.

I claim:

1. In a melt overflow casting apparatus having a rotatably driven casting wheel, the side of which molten metal is cast against and solidified as short, thin fibers, the casting wheel carrying the solidified metal fibers and projecting them onto a conveyor forming a continuous fiber mat, for transporting the fiber mat and a height control means for controlling the height of the top surface of a pool of molten metal, the improvement comprising:

(a) a sensing means for measuring the net width across the casting wheel of the cast metal fibers and;

(b) a control means for controlling the velocity of the conveyor in response to incremental changes in the net width across the casting wheel of the metal fibers for maintaining substantially constant linear density fiber mat.

2. A melt overflow casting apparatus in accordance with claim 1 wherein the sensing means comprises an infrared detector that detects infrared waves emitted from the metal fibers on the casting wheel.

3. A melt overflow casting apparatus in accordance with claim 1 or 2 wherein the control means also controls the angular velocity of the casting wheel in response to incremental changes in the linear density of the metal fiber mat.

4. A melt overflow casting apparatus in accordance with claim 1 wherein the improvement further comprises a weighing means for measuring the weight of a portion of the continuous metal fiber mat.

5. A melt overflow casting apparatus in accordance with claim 4 wherein the weighing means comprises a moving support surface which supports a specified length of the moving, continuous fiber mat, and measures the downward force of the supported length of moving fiber mat on the moving surface.

6. A melt overflow casting apparatus in accordance with claim 1 wherein the conveyor comprises a conveyor belt.

7. A melt overflow casting apparatus in accordance with claim 1 wherein the height control means comprises a plunging means for submersing into the molten metal, displacing metal and controlling the height of the top surface of the pool of molten metal.

8. A melt overflow casting apparatus in accordance with claim 1 wherein the height control means comprises a tilting hearth which contains the pool of molten metal and tilts toward the casting wheel causing the molten metal to overflow onto the casting wheel, and is tilted at a rate which is controlled by the control means.

9. In a melt overflow casting apparatus having a rotatably driven casting wheel, the side of which molten metal is cast against and solidified into a continuous strip, the casting wheel carrying the solidified metal strip and projecting it onto a conveyor for transporting the strip, and a height control means for controlling the height of the top surface of a pool of molten metal, the improvement comprising:

(a) a sensing means for measuring the net width across the casting wheel of the cast metal strip;
(b) a weighing means for measuring the weight of a length of the continuous metal strip; and
(c) a control means for controlling the angular velocity of the casting wheel in response to incremental changes in the net width and weight per unit length of the cast metal strip for maintaining substantially constant linear density strip.

10. A melt overflow casting apparatus in accordance with claim 9 wherein the sensing means comprises an infrared detector that detects infrared waves emitted from the metal strip on the casting wheel.

11. A melt overflow casting apparatus in accordance with claim 9 wherein the control means comprises:

(a) a computer that calculates the thickness of the strip from the net width and weight per unit length measurements, and converts the thickness value to an electric signal; and
(b) a negative feedback control means for receiving the electric signal from the computer, and sending a correcting electric signal to vary the angular velocity of the casting wheel.

12. A melt overflow casting apparatus in accordance with claim 9 or 10 wherein the control means controls the velocity of the conveyor in response to incremental changes in the angular velocity of the casting wheel for matching the velocity of the conveyor to the velocity of the outer peripheral surface of the casting wheel.

13. A melt overflow casting apparatus in accordance with claim 9 wherein the height control means is a plunger for submersing into the molten metal, displacing metal and controlling the height of the top surface of the pool of molten metal.

14. A melt overflow casting apparatus in accordance with claim 9 wherein the height control means comprises a tilting hearth which contains the pool of molten metal and tilts toward the casting wheel causing the molten metal to overflow onto the casting wheel, and is tilted at a rate which is controlled by the control means.

15. A melt overflow casting apparatus in accordance with claim 9 wherein the weighing means comprises a moving support surface which supports a specified length of the moving, continuous strip, and measures the downward force of the supported length of moving strip on the moving surface.

16. A melt overflow casting apparatus in accordance with claim 15 wherein the moving support surface comprises a conveyor belt made up of two or more cylindrical drums around which a continuous belt is wound.

17. In melt overflow casting including casting molten metal against a side of a rotating casting wheel, solidifying as fibers and projecting the fibers onto a conveyor, forming a mat, a method of controlling the linear density of the fiber mat comprising:

(a) measuring the net width of a stream of fibers across the casting wheel; and
(b) controlling the velocity of the conveyor in response to incremental changes in the net width of the metal fiber stream for maintaining a substantially constant linear density mat.

18. A method in accordance with claim 17 wherein the invention further comprises controlling the angular velocity of the casting wheel in response to incremental changes in the net width of the metal fiber mat.

19. A method in accordance with claim 17 wherein the invention further comprises weighing a portion of the continuous metal fiber mat.

20. In melt overflow casting including casting molten metal against a side of a rotating casting wheel, forming a continuous metal strip and projecting the metal strip onto a conveyor, a method of controlling the linear density of the continuous metal strip comprising:

(a) measuring the net width of the metal strip across the casting wheel;
(b) weighing a length of the continuous metal strip; and
(c) controlling the angular velocity of the casting wheel in response to incremental changes in the net width and weight per unit length of the metal strip for maintaining a substantially constant linear density strip.

21. A method in accordance with claim 20 wherein the method further comprises controlling the velocity of the conveyor in response to incremental changes in the angular velocity of the casting wheel for matching the velocity of the conveyor to the velocity of the outer peripheral surface of the casting wheel.

* * * * *